US005691294A

United States Patent [19]

France et al.

[11] Patent Number: 5,691,294

[45] Date of Patent: Nov. 25, 1997

[54] FLOW AIDS FOR DETERGENT POWDERS COMPRISING SODIUM ALUMINOSILICATE AND HYDROPHOBIC SILICA

[75] Inventors: Paul Amaat Raymond Gerard France, Kessel-Lo; Paul Irma Albertus Van Dijk, Putte, both of Belgium

[73] Assignee: The Procter & Gamble Company, Cincinnati, Ohio

[21] Appl. No.: 532,554

[22] PCT Filed: Feb. 23, 1994

[86] PCT No.: PCT/US94/01915

§ 371 Date: Dec. 11, 1995

§ 102(e) Date: Dec. 11, 1995

[87] PCT Pub. No.: WO94/23001

PCT Pub. Date: Oct. 13, 1994

[30] Foreign Application Priority Data

Mar. 30, 1993 [EP] European Pat. Off. ..... 93870059

[51] Int. Cl.[6] ..... C11D 17/06; C11D 3/12; C11D 3/32; C11D 11/00

[52] U.S. Cl. ..... 510/349; 510/350; 510/356; 510/441; 510/442; 510/443; 510/444; 510/501; 510/506; 510/507; 510/511

[58] Field of Search ..... 510/507, 511, 510/532, 315, 323, 441, 442, 452, 349, 350, 356, 443, 444, 501, 506

[56] References Cited

U.S. PATENT DOCUMENTS

| | | | |
|---|---|---|---|
| 3,868,336 | 2/1975 | Mazzola et al. | 252/527 |
| 4,192,761 | 3/1980 | Peltre et al. | 510/317 |
| 4,406,808 | 9/1983 | Gangwich et al. | 252/91 |
| 4,639,326 | 1/1987 | Czempik et al. | 252/91 |
| 4,666,740 | 5/1987 | Wixon | 427/214 |
| 4,869,843 | 9/1989 | Saito et al. | 252/135 |
| 4,970,017 | 11/1990 | Nakumura et al. | 252/174.13 |
| 5,030,379 | 7/1991 | Knight et al. | 252/174.25 |
| 5,300,250 | 4/1994 | Morgan et al. | 510/352 |
| 5,324,444 | 6/1994 | Berry et al. | 512/4 |
| 5,332,528 | 7/1994 | Pan et al. | 510/299 |
| 5,454,982 | 10/1995 | Murch et al. | 510/350 |
| 5,468,516 | 11/1995 | Yamashita et al. | 510/441 |

FOREIGN PATENT DOCUMENTS

| | | |
|---|---|---|
| 0 000 216 | 1/1979 | European Pat. Off. . |
| 0 013 028 A1 | 7/1980 | European Pat. Off. . |
| 0 329 842 A2 | 8/1989 | European Pat. Off. . |
| 0-351-937 | 1/1990 | European Pat. Off. . |
| 0 477 974 A2 | 4/1992 | European Pat. Off. . |
| 0-513-824 | 11/1992 | European Pat. Off. . |
| 61-069897 | 4/1986 | Japan . |
| 62-228000 | 6/1987 | Japan . |
| 62-228000 | 10/1987 | Japan . |

*Primary Examiner*—Ardith Hertzog
*Attorney, Agent, or Firm*—Jacobus C. Rasser; Jerry J. Yetter; Ken K. Patel

[57] ABSTRACT

Detergent components or compositions having a bulk density of at least 700 g/l comprise a nonionic surfactant system including at least one nonionic surfactant which is a liquid at temperatures below 40° C., and from about 0.5% to 15% by weight of the component or compositions of a flow aid which is a premixed powder comprising sodium aluminosilicate and hydrophobic silica in a weight ratio of from 100:1 to 5:1. The detergent components or compositions are made by free dispersion mixing or granulation.

14 Claims, No Drawings

FLOW AIDS FOR DETERGENT POWDERS COMPRISING SODIUM ALUMINOSILICATE AND HYDROPHOBIC SILICA

BACKGROUND OF THE INVENTION

The present invention relates to the use of flow aids for granular products which comprise a mixture of sodium aluminosilicate and silica in a narrowly defined ratio. The silica used is hydrophobic silica, preferably fumed hydrophobic silica. The ratio of sodium aluminosilicate to silica is from about 100:1 to about 3:1, preferably from 20:1 to 5:1, and most preferably around 10:1.

The flow aid is used in the process of manufacturing high density granular detergent components or compositions which comprise nonionic surfactants. It is most useful in combination with nonionic surfactants which are liquid at ambient temperature, and are therefore mobile. Without a suitable flow aid, the nonionic surfactant tends to leak from the powder and soak into the cardboard container which forms an unsightly stain. Although it is possible to avoid this problem by using lower levels of nonionic surfactant in the composition, or by selecting nonionic surfactants which have a lower solidification temperature, this limits the flexibility of formulation.

The use of flow aids in general which help to reduce the stickiness of detergent granules comprising nonionic surfactants, and which may help to increase bulk density is known, for example from the following prior art:

U.S. Pat. No. 3,868,336, published on 25th Feb., 1975, claims blends of detergent compositions with 0.5% to 15% by weight of a particulate water-insoluble flow-promoting agent for lessening, or eliminating caking, stickiness, and oiling out when an oily liquid detergency improver is applied. Although this patent discloses various flow-promoting agents, it does not disclose the advantages to be gained from mixing specific ratios of hydrophobic silica and aluminosilicates.

JP 61 069897, laid open 10th Apr., 1986 states that aluminosilicate, silicon dioxide, bentonite and clay having am average particle diameter of not more than 10 micrometers can be used as a surface modifier at a level of from 0.5% to 35%.

EP 0 351 937, published 24th Jan., 1990 and EP 0 352 135, published 24th Jan., 1990 disclose agglomeration processes carried out sequentially with high speed and low speed mixing. No finely divided particulate is present is the granulation step. However flow aids may be used, for example, aluminosilicates, precipitated silica and others are suitable.

EP 0 513 824, published 19th Nov., 1992, describes a process for making nonionic detergent granules and the use of a surface coating agent having a particle size of less than 10 micrometers.

In general, the prior art does not distinguish between the different types of silica which may be advantageously used as flow aids. In many cases the use of precipitated silicas is described. However, the majority of precipitated silicas which are commercially available are hydrophilic, and are therefore not useful in the present invention.

The present invention is aimed at making nonionic detergent agglomerates having a high bulk density and which comprise higher levels of nonionic surfactant than those of the prior art, but do not have the same leakage problems.

Another problem which is associated with making detergent agglomerates having a high bulk density is that the bulk density tends to change during storage, especially during the first few hours or days after manufacture. This in turn gives rise to problems of quality control, especially on packaging lines. It is a feature of the products of the present invention that changes in bulk density during storage are greatly reduced, or even eliminated.

The present invention also addresses the problem of achieving more control over particle size distribution of the finished product. One of the factors influencing particle size distribution is the effectiveness of the flow aid which is introduced near to the end of the manufacturing process. The flow aids of the present invention have been found to be more efficient in this regard.

SUMMARY OF THE INVENTION

The present invention relates to detergent components or compositions having a bulk density of at least 700 g/l which comprises a nonionic surfactant system which includes at least one nonionic surfactant which is a liquid at temperatures below 40° C., and from 0.5% to 15% by weight of the component or composition of a flow aid which is a premixed powder comprising sodium aluminosilicate and hydrophobic silica in the ratio of from 100:1 to 3:1. The invention also relates to a process for making such detergent components or compositions.

DESCRIPTION OF THE INVENTION

The present invention comprises two essential components; a granular detergent which comprises a nonionic surfactant which is a liquid at temperatures below 40° C., and a flow aid which is a premixed powder comprising sodium aluminosilicate and silica. Both of these components will now be described in more detail

Granular Detergent comprising Nonionic Surfactant

While any nonionic surfactant may be usefully employed in the present invention, two families of nonionics have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactacts wherein at least one nonionic surfactant is selected from each of the groups of alkoxylated alcohols and the polyhydroxy fatty acid amides.

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 moles of ethylene oxide per mole of alcohol.

It is a particular feature of the present invention that at least one of the nonionic surfactants used is a liquid at temperatures below 40° C. However, where a nonionic surfactant system which comprises more than one nonionic surfactant is used, the nonionic surfactant system as a whole may have a higher solidification temperature.

It is a particularly preferred embodiment of the present invention that the nonionic surfactant system also includes a polyhydroxy fatty acid amide component.

Polyhydroxy fatty acid amides may be produced by reacting a fatty acid ester and an N-alkyl polyhydroxy amine. The preferred amine for use in the present invention is N—(R1)—CH2(CH2OH)4—CH2—OH and the preferred ester is a C12–C20 fatty acid methyl ester. Most preferred is the reaction product of N-methyl glucamine with C12–C20 fatty acid methyl ester.

Methods of manufacturing polyhydroxy fatty acid amides have been described in WO 92 6073, published on 16th Apr., 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols (page 15, lines 22–27). This directly yields nonionic surfactant systems which are preferred in the present invention, such as those comprising N-methyl glucamide and C12–C14 alcohols with an average of 3 ethoxylate groups per molecule.

Nonionic surfactant systems, and granular detergents made from such systems have been described in WO 92 6160, published on 16th Apr., 1992. This application describes (example 15) a granular detergent composition prepared by fine dispersion mixing in an Eirich RV02 mixer which comprises N-methyl glucamide (10%), nonionic surfactant (10%).

Both of these patent applications describe nonionic surfactant systems together with suitable manufacturing processes for their synthesis, which have been found to be suitable for use in the present invention.

The present invention provides a method of making a granular detergent component which comprises an ethoxylated nonionic surfactant at a level of from 1% to 50% by weight of the component. The particular benefits of the invention will be even more evident when the ethoxylated nonionic surfactant is at a level of from 10% to 50% by weight of the detergent component or composition, preferably from 12% to 30% by weight, and even more preferably from 15% to 20% by weight.

The polyhydroxy fatty acid amide may be present in compositions of the present invention at a level of from 0% to 50% by weight of the detergent component or composition, preferably from 5% to 40% by weight, even more preferably from 10% to 30% by weight.

The surfactant system may also comprise anionic surfactants, indeed the inclusion of such surfactants may be of considerable advantage in order to improve the rate of solubility of the granular surfactant.

Anionic Surfactants

The laundry detergent compositions of the present invention can contain, in addition to the nonionic surfactant system of the present invention, one or more anionic surfactants as described below.

Alkyl Ester Sulfonate Surfactant

Alkyl Ester sulfonate surfactants hereof include linear esters of $C_8$–$C_{20}$ carboxylic acids (i.e. fatty acids) which are sulfonated with gaseous $SO_3$ according to "The Journal of the American Oil Chemists Society'" 52 (1975), pp. 323–329. Suitable starting materials would include natural fatty substances as derived from tallow, palm oil, etc.

The preferred alkyl ester sulfonate surfactant, especially for laundry applications, comprises alkyl ester sulfonate surfactants of the structural formula:

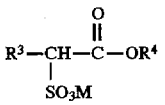

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl Sulfate Surfactant

Alkyl sulfate surfactants hereof are water soluble salts or acids or the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quarternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}$E(1.0)M, $C_{12}$–$C_{18}$ alkyl polyethoxylate (2.25) sulfate, $C_{12}$–$C_{18}$E(2.25)M), $C_{12}$–$C_{18}$ alkyl polyethoxylate (3.0) sulfate $C_{12}$–$C_{18}$E(3.0), and $C_{12}$–$C_{18}$ alkyl polyethoxylate (4.0) sulfate $C_{12}$–$C_{18}$E(4.0)M), wherein M is conveniently selected from sodium and potassium.

Other Anionic Surfactants

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ehtylene oxide); acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 3% to about 20% by weight of such anionic surfactants.

Other Surfactants

The laundry detergent compositions of the present invention may also contain cationic, ampholytic, zwitterionic, and semi-polar surfactants, as well as nonionic surfactants other than those already described herein, including the semi-polar nonionic amine oxides described below.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)y][R^4(OR^3)y]_2R^5N+X—$$

wherein R2 is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2COH—CHOHCOR^6CHOHCH_2OH$ wherein R6 is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

When included therein, the laundry detergent compositions of the present invention typically comprise from 0% to about 25%, preferably form about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched chain. One of the aliphatic substituents contains at least 8 carbon atoms, typically from about 8 to about 18 carbon atoms, and at least one contains an anionic water-solubilizing group e.g. carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

When included therein, the laundry detergent compositions of the present invention typically comprise form 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivates of heterocyclic secondary and tertiary amines, or derivatives of quaternary ammonium, quarternary phosphonium or tertiary sulfonium compounds. See U.S. Pat. No. 3,929,678 to Laughlin et al., issued Dec. 30, 1975 at columns 19, line 38 through column 22, line 48 (herein incorporated by reference) for examples of zwitterionic surfactants.

When included therein, the laundry detergent compositions of the present invention typically comprise form 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting af alkyl groups and hydrocyalkyl groups containing form about 1 to about 3 carbon atoms; water-soluble phosphine oxides containing one alkyl moiety of form about 10 to about 18 carbon atoms and 2 moieties selected form the group consisting of alkyl groups and hydroxyalkyl groups containing from about 1 to about 3 carbon atoms.

Semi-polar nonionic detergent surfactants include the amine oxide surfactants having the formula:

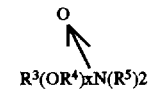

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is form 0 to about 3; and each $R^5$ is an alkyl or hydroxyalkyl group containing form about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

There amine oxide surfactants in particular include $C_{10}$–$C_{18}$ alkyl dimenthyl amine oxides and $C_8$–$C_{12}$ alkoxy ethyl dihydroxy ethyl amine oxides.

When included therein, the laundry detergent compositions of the present invention typically comprise form 0% to about 15%, preferably from about 1% to about 10% by weight of such semi-polar nonionic surfactants.

Normally the granular detergent will also contain other optional ingredients. Examples of such ingredients which are commonly used in detergents are given in more detail hereinbelow.

Flow Aid

The other essential feature of the present invention is the flow aid which comprises sodium aluminosilicate and silica.

Sodium aluminosilicate may take many forms. One example is crystalline aluminosilicate ion exchange material of the formula $$Na_z[(AlO_2)_z \cdot (SiO_2)_y] \cdot xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2 \cdot ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO2)_{12}] \cdot xH_2O$$

wherein x is from about 20 to about 30, especially about 27 and has a particle size generally less than about 5 microns.

Silica

Silica is a highly dispersed amorphous silicon dioxide. It is commercially available in many forms. Most commonly silica has a tapped density of from 50 g/l to 120 g/l. The specific surface area of the particles ranges from 25 square meters per gram to 800 square meters per gram. The surface of silica particles can be chemically modified to change their behaviour with respect to water. For example, silica particles may be treated with organosilanes to make the particles predominantly hydrophobic. It has been found that silicas must be hydrophobised to be useful in the present invention.

In commercial practice, silica is usually prepared by one of two techniques; either by precipitation or by high temperature flame hydrolysis. Precipitated silicas generally have an agglomerate size of from 3 micrometers 100 micrometers, whereas fumed silicas (made by flame hydrolysis) usually have primary particles which are generally spherical and have an average diameter of from 7 nm to 40 nm. Fumed silicas having an average primary particle size of from 7 to 25 nanometers are preferred in the present invention.

Examples of silicas which are particularly useful in the present invention include those supplied by Degussa AG, Frankfurt, Germany under the Trade Name "Aerosil". Aerosil R972 has been found to be particularly useful. This silica is a hydrophobic, fumed silica which has a specific surface area of about 110 square meters per gram and an average primary particle size of 16 nanometers.

Mixing the Flow Aid

For use in the present invention, the sodium aluminosilicate and the silica must be premixed in a ratio of from 100:1 to 3:1. Preferably the ratio will be from 20:1 to 5:1, and most preferably around 10:1, all ratios being by weight. The resulting premix is a free-flowing powder which is much easier to handle than either the zeolite power on its own, or the silica powder on its own. Sodium aluminosilicate powder alone is usually sticky and does not flow well. Silica powder on its own is very dusty, due to the very small particle size and low bulk density. However the flow aids of the present invention are a free-flowing, non-dusty powder.

It is necessary to mix the flow aid with the rest of the detergent composition. In order to achieve the benefits of the present invention, a level of the flow aid of from 0.5% to 15% by weight of the detergent composition is then mixed to coat the surfaces of the granules. Preferably the level of the flow aid is from 3% to 12% by weight, and most preferably about 10% by weight.

Optional Ingredients

Other ingredients which are known for use in detergent compositions may also be used as optional ingredients in the present invention. Examples of builders (other than aluminosilicates and silicas which have been described hereinabove), chelants, and polymers are included here in more detail.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

As mentioned above powders normally used in detergents such as zeolite, carbonate, silica, silicate, citrate, phosphate, perborate, etc. and process acids such as starch, can be used in preferred embodiments of the present invention.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000.

Polymeric polycarboxylate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Other Optionals Ingredients

Other ingredients commonly used in detergent compositions can be included in the compositions of the present invention. These include color speckles, bleaching agents and bleach activators, suds boosters or suds suppressors, antitarnish and anticorrosion agents, soil suspending agents, soil release agents, dyes, fillers, optical brighteners, germicides, pH adjusting agents, nonbuilder alkalinity sources, hydrotropes, enzymes, enzyme-stabilizing agents, and perfumes.

Process Details

Granular detergent components which comprise nonionic surfactants may be made by many methods which are known to the man skilled in the art including spray drying, absorption of nonionic surfactants into porous carrier particles and various types of granulation, or combinations of these techniques.

One particularly useful method of granulation is known as agglomeration. The term agglomeration is taken herein to mean the build-up of small particles to form the granular detergent having the required particle size.

Particles suitable for use in an agglomeration process may be in the form of powders of sodium aluminosilicate, carbonate, sulphate, citrate, silica, or mixtures of these, and the agglomeration may be effected in the presence of some or all of the nonionic surfactant system. One method of doing this is by combining the powders with a liquid or pasty component which may comprise nonionic surfactant in a fine dispersion mixer or granulator.

One particularly preferred process is to agglomerate one or more powders comprising a premix of sodium aluminosilicate and silica. In this embodiment of the invention the following steps are suitable:

i) fine dispersion mixing or granulation of at least one nonionic surfactant which is a liquid at temperatures below 40° C. in the presence of an effective amount of a powder which comprises sodium aluminosilicate and hydrophobic silica, wherein the ratio of the sodium aluminosilicate to silica is from 100:1 to 3:1.

Suitable pieces of equipment in which to carry out the fine dispersion mixing or granulation of the present invention are mixers of the Fukae™ FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna™ V series ex Dierks & Söhne, Germany; and the Pharma Matrix™ ex T K Fielder Ltd., England. Other mixers believed to be suitable for use in the process of the invention are the Fuji™ VG-C series ex Fuji Sangyo Co., Japan; and the Roto™ ex Zanchetta & Co srl, Italy.

Other preferred suitable equipment can include Eirich™, series RV, manufactured by Gustau Eirich Hardheim, Germany; Lödige™, series FM for batch mixing, series Baud KM for continuous mixing/agglomeration, manufactured by Lödige Machinenbau GmbH, Paderborn Germany; Drais™ T160 series, manufactured by Drais Werke GmbH, Mannheim Germany; and Winkworth™ RT 25 series, manufactured by Winkworth Machinery Ltd., Berkshire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

One particularly preferred process method is to prepare the detergent granules by an agglomeration techniques such as the fine dispersion mixing and granulation process described above, and to spray some or all of the nonionic surfactant on to detergent granules in one a suitable mixer or rotating drum. Any of the mixers described above may be found to be suitable for this.

The following steps may be used in this embodiment of the invention:

i) making a nonionic surfactant system which comprises at least one nonionic surfactant which is a liquid at temperatures below 40° C.;

ii) making a granular detergent powder having a bulk density of at least 650 g/l;

iii) spraying on a part of, or all of the nonionic surfactant system of step i) on to the granular detergent powder of step ii);

iv) mixing the product of step iii) with a premixed powder which comprises sodium aluminosilicate and hydrophobic silica, wherein the premixed powder is used at a level of from 3% to 15% by weight of the finished detergent component or composition and that the ratio of the sodium aluminosilicate to silica is from 100:1 to 3:1.

The granular detergent powder in step ii) is preferably made by agglomeration of detergent pastes, most preferably using a process of fine dispersion mixing or granulation.

Even more preferably the detergent agglomerates are then dry mixed with other optional ingredients.

The process is described in more details in the Applicant's co-pending European Patent application no. 92870138.2.

It is expected that the flow aids of the present invention will be added towards the end of the process and will help to prevent further agglomeration of the components which could lead to oversized particle distribution. The flow aid may be incorporated by any suitable means, a rotating drum or mixer of the ploughshare type are most preferred.

EXAMPLES

In these examples the following abbreviations have been used:

| | |
|---|---|
| C45AS | Sodium $C_{14}$–$C_{15}$ alkyl sulfate |
| C35AE3S | $C_{13}$–$C_{15}$ alkyl ethoxysulfate containing an average of three ethoxy groups per mole |
| CMC | Sodium carboxymethyl cellulose |
| C25E3 | A $C_{12-15}$ primary alcohol condensed with an average of 3 moles of ethylene oxide |
| TAED | Tetraacetyl ethylene diamine |

EXAMPLES 1–7

A mixture of granular raw materials was prepared according to the following composition:

| | % by weight |
|---|---|
| Anionic surfactant agglomerate* | 30 |
| Layered silicate compacted granule (supplied by Hoechst under trade name SKS-6) | 18 |
| Percarbonate (supplied by Interox) | 25 |
| TAED agglomerate | 9 |
| Suds suppressor agglomerate | 2 |
| Perfume encapsulate | 0.2 |
| Granular dense soda ash | 8.4 |
| Granular acrylic-maleic copolymer | 3.2 |
| Enzymes | 3.6 |
| Granular soil release polymer | 0.6 |
| | 100 |

*Anionic surfactant agglomerates were made from a 78% active surfactant paste which comprises C45AS/C35AE3S in the ratio of 80:20. The paste was agglomerated with a powder mixture according to the process described in EPA510746. The resulting anionic surfactant granule had a composition of 30% C45AS, 7.5% C35AE3S, 24% zeolite, 20% carbonate, 2.5% CMC, 12% acrylic-maleic co-polymer, and the balance of moisture.

The mixture of granular ingredients listed above was placed inside a 140 liter rotating drum that operates at 25 rpm. While operating the drum a mixture of nonionic surfactant (C25E3) and a 20% aqueous solution of optical brightener at ratios of 14:1 were sprayed onto the granular mixture to a level of 7% by weight of the granular components. The spraying time was about 1–2 minutes. Immediately afterwards, perfume was sprayed on, at a level of 0.5% by weight of the granular components, while rotating the drum. Then, without stopping the rotation of the drum, a flow aid was slowly added to the mixer, taking about 30 seconds. The level and type of flow aids used is given below in Table 1. Once the addition of flow aid was finished, the mixer was allowed to rotate for about 1 minutes and was then stopped. The finished product was then removed from the rotating drum.

The following flow aids were prepared using Zeolite A and Aerosil R792 (Trade name) both supplied by Degussa. Mixtures were prepared in a Lodige FM 130 (Trade name) by operating at 165 rpm for 0.5 minutes.

TABLE 1

| Flow aids | Level (%) on finished product | Product No |
|---|---|---|
| 100% Hydrophobic Silica | 1 | A |
| | 3 | B |
| | 5 | C |
| 20% Hydrophobic Silica/ 80% Zeolite | 3 | 1 |
| | 5 | 2 |
| | 10 | 3 |
| | 15 | 4 |
| 10% Hydrophobic Silica/ 90% Zeolite | 5 | 5 |
| | 10 | 6 |
| | 15 | 7 |
| 100% Zeolite | 5 | D |
| | 10 | E |
| | 15 | F |

Examples 1 to 7 were made using flow aids of the present invention. Examples A to F are comparative examples. The different flow aids were tested in a Hosokawa Powder Characteristics tester type PT-E for flowability and floodability. The results are listed in Table 2, given below.

TABLE 2

| Flow aids | flowability index | floodability index |
|---|---|---|
| 100% Hydrophobic Silica | n.a. | n.a. |
| 20% Hydrophobic Silica/ 80% Zeolite | 47 | 79.5 |
| 10% Hydrophobic Silica/ 90% Zeolite | 43.5 | 76 |
| 1% Hydrophobic Silica/ 99% Zeolite | 31 | 75 |
| 100% Zeolite | 12 | 48 |

note:
n.a. = data not available

The data in Table 2, indicates that the flowability of zeolites is significantly improved by adding small amounts of hydrophobic silica Aerosil R 972. No improvement was found by using hydrophilic silica, e.g. Sipernat 22S (Trade name) from Degussa. The floodability index gives an indication of the behavior of a bulk material when it changes from a resting to a moving state. An increasing floodability index indicates easier bulk handling of the flow aid.

The different dusting agents, as listed in Table 1, were used to make finished product. Those products were tested on density and dispensing. Density was measured using the repour cup method. The dispensing test is described in section B.

TABLE 3

| Flow aids | Product No | Density (g/L) | Dispensing (%) |
|---|---|---|---|
| 100% Aerosil R972 | C | 715 | 64 |
| 20% Aerosil/ 80% Zeolite | 3 | 750 | 15 |
| 10% Aerosil/ 90% Zeolite | 6 | 790 | 9 |
| 100% Zeolite | E | 775 | 10 |

The effect of different types of dusting agents on particle size distribution is listed in Table 4, given below.

The highest densities were obtained with the 90% zeolite/10% silica dusting. Higher levels of silica reduces the finished product density significantly. The 90% zeolite/10% silica gave also the lowest cake strength values. Too high levels of silica increase the dispensing residues.

Table 4 shows that a narrower particle size distribution is obtained (as indicated by a smaller standard geometric deviation) from the products of the invention (examples 3 and 6) than from a 100% zeolite flow aid (comparative example E)

TABLE 4

| | | % by weight of product on sieve | | |
|---|---|---|---|---|
| | | 3 | 6 | E |
| Tyler Sieve no | microns | | | |
| 14 | 1180 | 22 | 21 | 25 |
| 20 | 850 | 52 | 48 | 53 |
| 35 | 425 | 95 | 97 | 92 |
| 65 | 212 | 99 | 99 | 97 |
| 100 | 150 | 100 | 100 | 100 |
| Average particle size (microns) | | 782 | 762 | 797 |
| Standard geometric deviation | | 0.553 | 0.521 | 0.634 |

Data from Table 4 shows that the narrowest particle size distribution is obtained when using 10% Aerosil/90% Zeolite.

The nonionic surfactant leaking from the powder into the cardboard container, has been checked for all the products, by visual inspection of the inside wetting of the boxes.

The products were evaluated for nonionic leakage according to the following visual grading:

| Grade | Description |
|---|---|
| 1 | no leakage |
| 2 | 25% of area of box in contact with powder is wetted |
| 3 | 50% of area of box in contact with powder is wetted |
| 4 | 75% of area of box in contact with powder is wetted |
| 5 | 100% of area of box in contact with powder is wetted |

Products were put on storage for 3 weeks at 35° C.

| Product no | Grade |
|---|---|
| A | 3 |
| C | 1 |
| 3 | 1 |
| 6 | 1–2 |
| E | 4–5 |
| F | 4–5 |

The use of flow aids comprising hydrophobic silica significantly reduced the nonionic leaking. No improvement with a 100% Zeolite flow aid was observed.

EXAMPLE 8

A mixture of granular raw materials was prepared according to the composition given in examples 1–7. The mixture of granular ingredients described above was placed inside a 140 liter rotating drum that operates at 25 rpm. While operating the drum a mixture of nonionic surfactants (C25E3) and a 20% aqueous solution of optical brightener at ratios of 14:1 were sprayed onto the granular mixture to a level of 7% by weight of the granular composition. The spraying time was about 1–2 minutes. Immediately afterwards, perfume is sprayed on, at a level of 0.5% by weight of the granular composition while rotating the drum. Then, the product is transferred to a Lodige FM 130 batch mixer, where the flow aid was added at a level of 10% by weight of the granular composition. The mixer was started and samples were taken at different time intervals and checked for density. Two different flow aids were compared and density was measured for fresh product, and for product after 24 hours storage. Results are listed in Table 5, given below.

TABLE 5

| Residence Time (min) R972 | Density difference upon aging (g/L)* 100% Zeolite | 90% Zeolite/ 10% Aerosil |
|---|---|---|
| 1 | 15 | 6 |
| 2 | 19 | 4 |
| 3 | 16 | 6 |
| 4 | 21 | 9 |
| 5 | 38 | 15 |

note:
*density difference upon aging = product density after 24 hrs aging – fresh finished product density The above data shows that dusting with zeolite gave a density difference of 15–38 g/L between fresh and aged product. However when a premix of zeolite/silica was used as a flow aid, the aging effect was significantly lower, 5–15 g/L, while the final density was still the same or higher (880 g/L).

EXAMPLE 9

This example describes the process in batch mode in a pilot plant scale high shear mixer, an Eirich RV02, to produce high active nonionic detergent agglomerates without nonionic leakage problems. The mixer was filled first with a mixture of powders to be used, in this particular case zeolite A and fine sodium carbonate. A nonionic surfactant paste with a activity of 90%, comprising a mixture of ethoxylated nonionic surfactant and polyhydroxy fatty acid amides, was then added on top of the powder mixture while the mixer is being operated at 1600 rpm. Enough paste was added until the granulation is achieved. The agglomerates are then transferred to a rotating drum mixer and dusted for 1–2 minutes with a flow aid at a level of 5 or 10% by weight of the granular detergent. The composition of the agglomerates was given below in Table 6.

TABLE 6

| | Product 9 A % by weight | Product 9 B % by weight |
|---|---|---|
| Polyhydroxy fatty acid amide | 8.75 | 7.0 |
| Alcohol Ethoxylate nonionic | 26.25 | 21.0 |
| Sodium alkyl sulphate | — | 7.0 |
| Sodium carbonate | 32.5 | 32.5 |

TABLE 6-continued

| | Product 9 A % by weight | Product 9 B % by weight |
|---|---|---|
| Zeolite | 26.0 | 26.0 |
| Misc/water | 6.5 | 6.5 |

The resulting agglomerates were made with a detergent activity of 35% and a density of 700g/L. The dusted agglomerates were packed into cardboard containers and checked for nonionic leaking.

| Flow aids | % flow aid | nonionic leakage (9A & 9B) |
|---|---|---|
| 100% Zeolite | 5 | grade 5 |
| | 10 | grade 5 |
| 90% Zeolite/10% Silica | 5 | grade 3 |
| | 10 | grade 1 |

EXAMPLE 10

Example 10 is similar to Example 9. In this case a Lodige FM mixer, fitted with internal ploughs and high speed choppers with cutter blades, was used as an agglomerator. The mixer was filled first with a mixture of powders to be used and a mixture of surfactant paste was added on top. The composition of the agglomerates is given below in Table 7. The mixer is then started until granulation is achieved. The agglomerates are then dusted for 1–2 minutes with a flow aid at a level of 5 or 10% by weight of the granular detergent in a low shear KM Lodige mixer or a rotating drum mixer.

TABLE 7

| | Product 10 A % by weight | Product 10 B % by weight |
|---|---|---|
| Polyhydroxy fatty acid amide | 15 | 10 |
| Alcohol Ethoxylate nonionic | 15 | 10 |
| Anionic surfactant | 10 | 20 |
| Sodium carbonate | 20 | 20 |
| Zeolite | 16 | 16 |
| Miscellaneous/water | 4 | 4 |

| Flow aid | % flow aid | nonionic leakage (10A & 10B) |
|---|---|---|
| 100% Zeolite | 5 | grade 5 |
| | 10 | grade 5 |
| 90% Zeolite/10% Silica | 5 | grade 3 |
| | 10 | grade 1 |

A high active agglomerate is made with reduced stickiness and no nonionic leakage when coated with a mixture of 80% Zeolite and 20% Hydrophobic Silica Aerosil R972.

Section B—Test Methods

Dispensing under Stressed Conditions (Zanussi™ Method)

| | Equipment |
|---|---|
| 1) Dispenser | Zanussi shower type dispenser. The mainwash compartment will be used. |
| 2) Water | City water. |

-continued

| Equipment | |
|---|---|
| 3) Water Temperature | 20 ± 1° C. |
| 4) Water Flow | 2 ± 0.05 L per 60 ± 1 seconds. The test runs for 2 minutes. Calibrate the water flow rate using a measuring cylinder or similar receiver. |
| 5) Sample Mass | 150 ± 0.5 g of the test product. |

Experimental Procedure

1) Calibrate the equipment for above operating conditions. Ensure that the whole experimental rig is horizontal and that none of the nozzles of the dispenser are blocked.
2) Weigh the required amount of product to be tested in a cup. Ensure that the sample is representative of the entire product (avoid segregation when filling the cup).
3) Weigh the dispenser drawer after ensuring that it is properly dried.
4) Place a vertical positioning screen in the mainwash section of the dispenser, so that it blocks the width of the drawer at a distance of 12.5 cm from the end of the drawer furthest from the water exit. Pour the product into the dispenser between the vertical positioning screen and the end of the drawer furthest from the water exit. The powder should be poured in such a way as to keep the powder surface as level as possible. Remove the screen.
5) Place the dispenser drawer gently in its slot, ensuring it is fully home.
6) Start water at the calibrated flow rate. Ensure that water is flowing entirely in the mainwash compartment.
7) Stop the water flow after 2 minutes and wait until the water drain from the drawer is completely stopped.
8) Remove the drawer from the slot and drain any excess water by slight tilting of the drawer. Ensure that no product falls from the drawer. There should be no water in any other compartment of the drawer. If some water is found, the system needs rechecking to ensure that all the water flow goes in the mainwash compartment.
9) Weigh the dispenser drawer with total residues.
10) Repeat the determination at least 5 times.
11) Average the wet residues. The result is expressed in % wt of the initial amount of dry product.

Accuracy and Assessment

Significant differences between products can be assessed when the average percent residues differ in 10% or more. A product is considered to show good dispensing profile if under this stressed test is below 30% residue at 2 L/min.

What is claimed is:

1. A granular detergent component or composition having a bulk density of at least 700 g/l which comprises:

i) a detergent powder which comprises a nonionic surfactant mixture comprising at least one nonionic surfactant selected from the group consisting of ethoxylated alcohols, and at least one nonionic surfactant selected from the group consisting of polyhydroxy fatty acid amides, and ii) from 0.5% to 15% by weight of a powdery flow aid characterised in that the flow aid comprises sodium aluminosilicate and hydrophobic silica wherein the weight ratio of the sodium aluminosilicate to hydrophobic silica is from 100:1 to 5:1.

2. A detergent component or composition according to claim 1 which comprises from 20% to 80% by weight of said nonionic surfactant mixture.

3. A detergent component or composition according to claim 1 which comprises at least one nonionic surfactant which is a liquid at temperatures below 40° C.

4. A detergent component or composition according to claim 1 which comprises at least one nonionic surfactant selected from the group consisting of ethoxylated alcohols having an alkyl group consisting of 9 to 15 carbon atoms and an average of from 2 to 10 ethoxylated groups per molecule, and at least one nonionic surfactant selected from the group of N-methyl glucamides having an alkyl group consisting of 12 to 18 carbon groups.

5. A detergent component or composition according to claim 1 wherein the silica is a hydrophobic fumed silica having an average primary particle size of from 7 to 25 nanometers.

6. A detergent component or composition according to claim 1 wherein the sodium aluminosilicate is a hydrated, crystalline aluminosilicate.

7. A detergent component or composition according to claim 1 wherein the ratio of aluminosilicate to silica is about 10:1 by weight.

8. The granular detergent component or composition according to claim 1 wherein the weight ratio of ethoxylated alcohol to the polyhydroxy fatty acid amide is from about 3:1 to about 1:1 in said detergent powder.

9. A process for making a free-flowing detergent powder having a bulk density of at least 700 g/l which comprises the steps of:

i) providing a nonionic surfactant system comprising at least one nonionic surfactant which is a liquid at temperatures below 40° C.;

ii) providing a granular detergent powder having a bulk density of at least 650 g/l;

iii) spraying the nonionic surfactant system onto the granular detergent powder;

iv) mixing the product of step iii) with a premixed powder comprising sodium aluminosilicate and hydrophobic silica in a weight ratio of from 100:1 to 5:1, wherein the flee-flowing detergent powder comprises from 3% to 15% by weight of the premixed powder.

10. A process according to claim 9, wherein the ratio of aluminosilicate to silica is about 10:1 by weight.

11. A process for making a free-flowing detergent powder having a bulk density of at least 700 g/l which comprises the step of:

fine dispersion mixing or granulating at least one nonionic surfactant which is a liquid at temperatures below 40° C. in the presence of a premixed powder comprising sodium aluminosilicate and hydrophobic silica, wherein the ratio of the sodium aluminosilicate to silica is from 100:1 to 5:1 by weight, and further wherein the free-flowing detergent powder comprises 0.5 to 15% by weight of the premixed powder.

12. A process according to claim 11, wherein the at least one nonionic surfactant which is a liquid at temperatures below 40° C. comprises an ethoxylated alcohol, and is premixed with at least one nonionic polyhydroxy fatty acid amide surfactant before the fine dispersion mixing or granulation.

13. A process according to claim 12, wherein the ratio of aluminosilicate to silica is about 10:1 by weight.

14. A process according to claim 11, wherein the ratio of aluminosilicate to silica is about 10:1 by weight.

* * * * *